US010920726B2

(12) United States Patent
Huff

(10) Patent No.: US 10,920,726 B2
(45) Date of Patent: Feb. 16, 2021

(54) MULTI-FUNCTION FUEL INJECTOR FOR INTERNAL COMBUSTION ENGINES AND METHOD

(71) Applicant: Reggie Dwayne Huff, Brookings, SD (US)

(72) Inventor: Reggie Dwayne Huff, Brookings, SD (US)

(73) Assignee: XCENTRICK INNOVATIONS, LTD., Brookings, SD (US)

( * ) Notice: Subject to any disclaimer, the term of this patent is extended or adjusted under 35 U.S.C. 154(b) by 0 days.

(21) Appl. No.: 15/732,877

(22) PCT Filed: Jul. 13, 2016

(86) PCT No.: PCT/US2016/000059
§ 371 (c)(1),
(2) Date: Jan. 11, 2018

(87) PCT Pub. No.: WO2017/034608
PCT Pub. Date: Mar. 2, 2017

(65) Prior Publication Data

US 2018/0202403 A1 Jul. 19, 2018

(51) Int. Cl.
*F02M 61/16* (2006.01)
*F02M 61/18* (2006.01)
(Continued)

(52) U.S. Cl.
CPC ..... *F02M 61/162* (2013.01); *F02M 51/061* (2013.01); *F02M 61/145* (2013.01);
(Continued)

(58) Field of Classification Search
CPC ..... F02M 61/162; F02M 51/061; F02M 61/1813; F02M 69/047
(Continued)

(56) References Cited

U.S. PATENT DOCUMENTS 3,834,678 A * 9/1974 Baribeau ..... F02M 69/02 261/41.5
4,657,189 A * 4/1987 Iwata ..... F02M 51/0678 239/533.12

(Continued)

*Primary Examiner* — David Hamaoui
*Assistant Examiner* — John D Bailey

(57) ABSTRACT

In the preferred embodiments an air flow diverting blade is integral to a base that doubles as a collar designed to co-axially attach to the nozzle tip end of a typical port fuel injector for internal combustion engines.

Upon simple manual manipulation of the set rotational angle of the typically externally exposed portion of the port fuel injector along its longitudinal axis, as typical modern port injection systems allow after installation, the angle of the intra-port flow diverting blade can be selectively varied to either straighten existing swirl and increase top end flow, or, introduce lateral directional swirl to whatever angle and intensity in either direction is desired. The functional use of a typical port fuel injector is thereby elevated to a multi-function of tunable fuel and air flow control at the point of induction into a combustion chamber without any modification to existing engine designs or their engine management control systems employed therefore. The flow diverting blade can be configured to divert flow around the intake valve stem, guide and guide boss in such a manner to optimize the overall flow dimension of the induction system of a typical internal combustion engine. The flow diverting blade also provides an effective means by which the proximity and angle of fuel injection, relative to the combustion chamber, can be altered and improved as desired. The flow diverting blade also provides an effective means by which a modest increase in effective fuel injector nozzle pressure and fuel vaporization can be realized.

22 Claims, 6 Drawing Sheets

(51) Int. Cl.
*F02M 69/04* (2006.01)
*F02M 51/06* (2006.01)
*F02M 61/14* (2006.01)

(52) U.S. Cl.
CPC ..... *F02M 61/18* (2013.01); *F02M 61/1813* (2013.01); *F02M 69/047* (2013.01)

(58) Field of Classification Search
USPC ..... 123/472
See application file for complete search history.

(56) References Cited

U.S. PATENT DOCUMENTS 4,979,479 A * 12/1990 Furukawa ..... F02M 51/0675 123/472
5,054,456 A * 10/1991 Rush, II ..... F02M 69/08 123/531
5,150,691 A * 9/1992 Imajo ..... F02F 1/4214 123/308
5,156,133 A * 10/1992 Sugimoto ..... F02M 39/00 123/531
5,167,211 A * 12/1992 Fukuma ..... F02B 31/085 123/308
5,241,938 A * 9/1993 Takagi ..... F02M 51/0675 123/472
5,694,898 A * 12/1997 Pontoppidan ..... F02M 51/08 123/470
5,725,158 A * 3/1998 Klaski ..... F02M 61/16 239/522
6,308,901 B1 * 10/2001 Nitkiewicz ..... F02M 61/166 239/391
6,802,284 B2 * 10/2004 Hironaka ..... F02M 51/0675 123/478
2009/0121603 A1 * 5/2009 Below ..... H01T 13/08 313/143
2017/0314491 A1 * 11/2017 John ..... F02M 63/0043

* cited by examiner

MULTI-FUNCTION FUEL INJECTOR FOR INTERNAL COMBUSTION ENGINES AND METHOD

BACKGROUND

The generation of a lateral directional swirl condition from the mass airflow stream within the induction conduit (or main port) of the typical Internal combustion (IC) engine generated during its intake cycle has long been recognized as a means to enhance certain desirable performance aspects therein. The goal is to find the perfect balance between the amplitude and/or angle of swirl generated and a reduction in the high end airflow dimension which results in reduced top end performance. Further, the optimal preferred lateral direction of the swirl, from either the left or the right, varies with different IC engine configurations. Vapor-phasing liquid fuel independent of excessive waste heat has also been shown to provide enhanced overall engine efficiency and environmental compatibility. Further, in port fuel injected engines, the location of the final fuel distribution point as well as the angle relative to the longitudinal center axis of a port fuel injector has been shown to be of value in maximizing the performance benefits of port fuel injection systems.

Many attempts to create fixed intra-port mass airflow diversion or swirl generators independent of direct fuel flow diversion and/or vapor-phasing have been made in the past. Further, Several attempts to create selectively variable intra-port swirl generators have been made such as Sakurai et al, U.S. Pat. No. 4,700,669 to Toyota and Khalighi et al, U.S. Pat. No. 4,827,883 to GM. These devices are also independent of direct fuel flow diversion and/or vapor-phasing capability. These devices are designed to allow for on the fly mass airflow directional variability, but, are very complicated and costly to implement and produce greatly limiting their overall market potential.

Klaski et al, U.S. Pat. No. 5,725,158 to Bosch discloses a simple approach to injecting liquid fuel deeper into the induction conduit where it can then be deflected and/or dispersed in an advantageous manner. The Klaski device is very narrowly focused on the single task of redirecting post nozzle injected liquid fuel. As such the fundamental functions of the device are antithetical to those of the here disclosed invention in key aspects. Any diversion of mass air flow created by the Klaski device is incidental to the goal to shield a "cord-like jet" stream of injected liquid fuel from any disruption of its path, in full liquid form, to its final distribution point. The final distribution point is a physical obstruction placed in the path of the "cord-like jet" stream of injected liquid fuel. The only energy supplied for this distribution method is that from a fuel pump. Conversely, in the most preferred of several embodiments, the mufti-function flow diversion device disclosed herein is specifically designed to direct a portion of the induction mass air flow directly into the path of the injected liquid fuel flow and combine the energy of both a fuel pump AND the mass air flow to produce a far superior final fuel distribution outcome. Further, in light of the fundamentally antithetical goals, Klaski actually seeks to keep mass air flow diversion to an absolute minimum and not allow for any useful range of variability for generating swirl or any other purpose. Further, the Klaski device is not well suited for the aftermarket or aftermarket retro-fit as it requires a specially designed fuel injector nozzle not normally used in OEM fuel injectors.

Alternatively, the here disclosed invention is specifically designed to address the useful considerations of ease of selectively variable induction conduit mass air and/or air & fuel swirl and/or redirection, control and the amplitude of the same, combined with improved fuel delivery location and combustion efficient condition through vapor-phasing. All of this can be achieved with simplicity and extreme ease of implementation into OEM production, or, as an aftermarket upgrade, and, at a cost that ranges from low to less than zero (0). The here disclosed invention can take advantage of the main obstruction within an induction conduit, which is, the intake valve stem and guide boss, in most applications, to actually create potential for an increase in top end flow dimension. This may allow for some additional lateral directional swirl to be introduced and the benefits therefore realized without reducing top end flow dimension which can add additional top end performance. The here disclosed invention further allows, in certain situations, to actually reduce existing swirl and straighten the flow to affect higher top end flow dimension if so desired and to do so with ease.

This application is related to and a continuation of provisional patent application No. 62/176,270 dated Feb. 18, 2015 & No. 62/231,678 dated Jul. 13, 2015.

BRIEF SUMMARY OF INVENTION

An Intra-Port Air and Fuel Flow Diversion Device:

The typical modern IC engine port fuel injection system utilizes an electromagnetic solenoid based port fuel injector for providing per-determined variably timed and metered injection of primarily liquid fuel into the mass inducted air stream on its way to the combustion chamber by way of a main port or induction conduit, primarily during the intake cycle. The port fuel injector is typically a small cylindrical tube like structure that accepts pressurized fuel at its inlet end and uses an electromagnetic solenoid within its main body to control an internal valve, that, when open, delivers pressurized fuel to the fuel spray nozzle tip end.

Such systems generally allow for ease of removal and installation of the port fuel injectors within and onto the top of the induction conduit or intake manifold by means of a mounting sub-port therein. Such systems generally allow for a significant range of free angled rotation of the fuel injector along its center longitudinal axis in the fully seated and installed position without impacting its performance or causing leaks or any other negative issue. By attaching a an airflow diverting blade like structure to the intra-port tip end of the fuel injector it is possible to take advantage of the typical fuel injector's externally selectively variable rotational angle range of motion to allow for ease post install of manual selection of the angle of the intra-port blade like structure and precisely and incrementally increase or decrease the amplitude and/or angle and/or direction of the air & fuel flow diversion and fuel swirl desired for each individual cylinder therein. These factors make the invention very well suited for very low cost and rapid OEM production and/or the aftermarket, but do not preclude other more complex and/or fixed adaptation of its novel combined functions. Post install externally visible indexing marks, as part of the adapted blade like flow diversion device OR as added to the OEM fuel injector itself, allows for the intra-port adjustable airflow diversion device to be precisely indexed relative to its coaxial engagement with the fuel injector itself and/or relative to the longitudinal induction conduit flow direction, in order to optimize performance and/or fuel efficiency with ease.

Further the opportunity to improve the fuel delivery location and combustion efficient condition through vapor-phasing is created. This is accomplished Through the addition of the carburetor like barrel and venturi arrangement which when combined with typical port fuel injection creates a Hybrid Fuel Injection (HFI) system. With this system it is possible to create the venturi effect without necessarily reproducing the typical carburetor like ID profile. HFI is capable of maximizing the potential of both systems simultaneously with a simple low cost device that has no moving parts and is self cleaning making it zero (0) maintenance and zero (0) service required for beyond the life of the engine. Early indications from real world application is that HFI may keep an engine internally cleaner than even port fuel injection which is far superior to Direct Injection (DI). HFI can provide much of the same benefits of DI without all the cost, complexity, safety and maintenance drawbacks.

BRIEF DESCRIPTION OF DRAWINGS

FIG. 3 including a section reference to FIG. 5.

FIG. 5 also illustrating mass induction port airflow around the blade like profile from the leading edge to the trailing edge at a neutral angle to the mass airflow. FIG. 5 also contrasting the reduced total linear surface length of at least one side of a preferred blade profile to that of a theoretical hemisphere with the same base diameter. FIG. 5 also illustrating one of many possible alternative angles of the blade profile relative to the direction of the mass airflow which is typically achieved by rotating the blade upon its proximate center axis, in this case, 20°+.

DETAILED DESCRIPTION OF INVENTION

Figure 1:
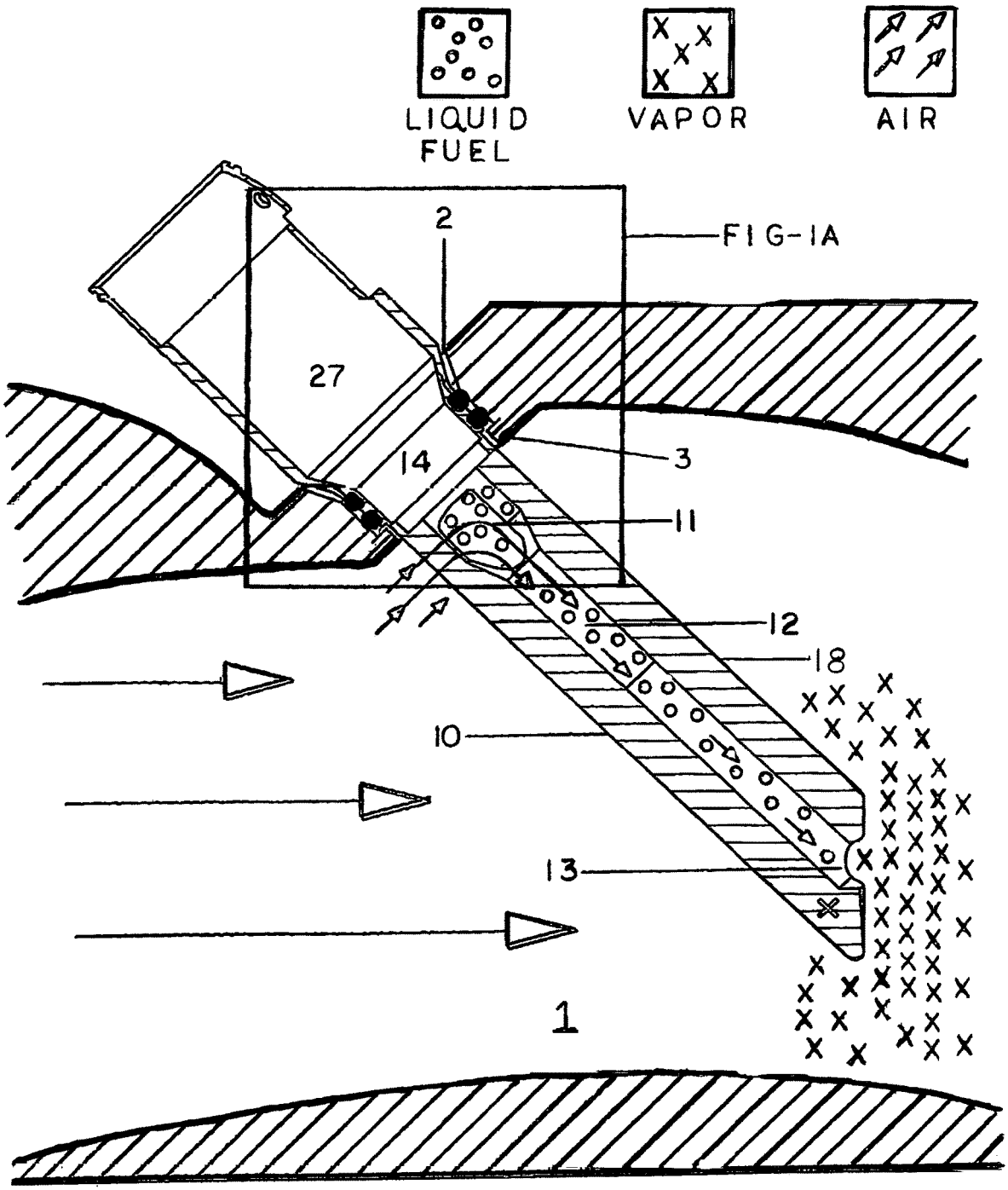
FIG. 1 is a cut away side view dynamic illustration of the interaction of the key forces and elements which constitute a functioning retro fit air and fuel flow diversion blade unit as installed in a typical stepped fuel injector mounting port of a typical port fuel injected IC engine.
Figure 2:
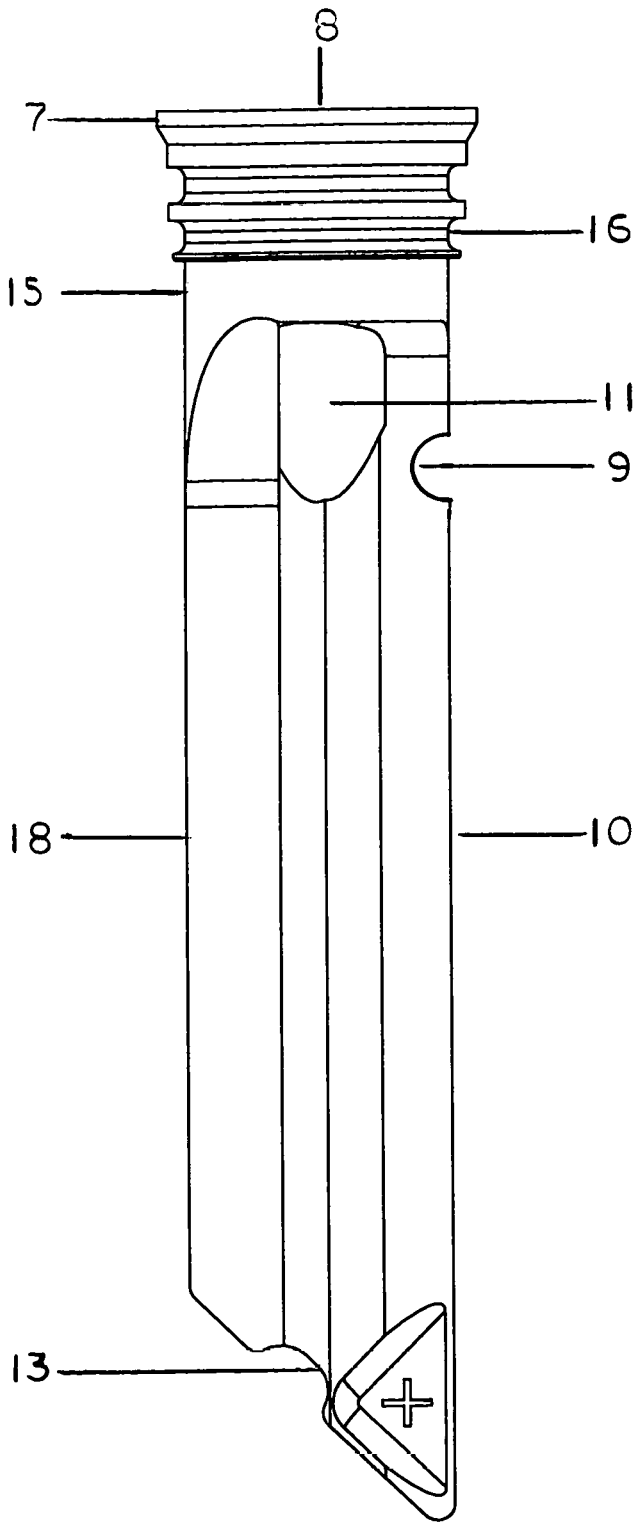
FIG. 2 is a side view of the retro fit or integral air and fuel flow diversion blade unit itself.
Figure 3:
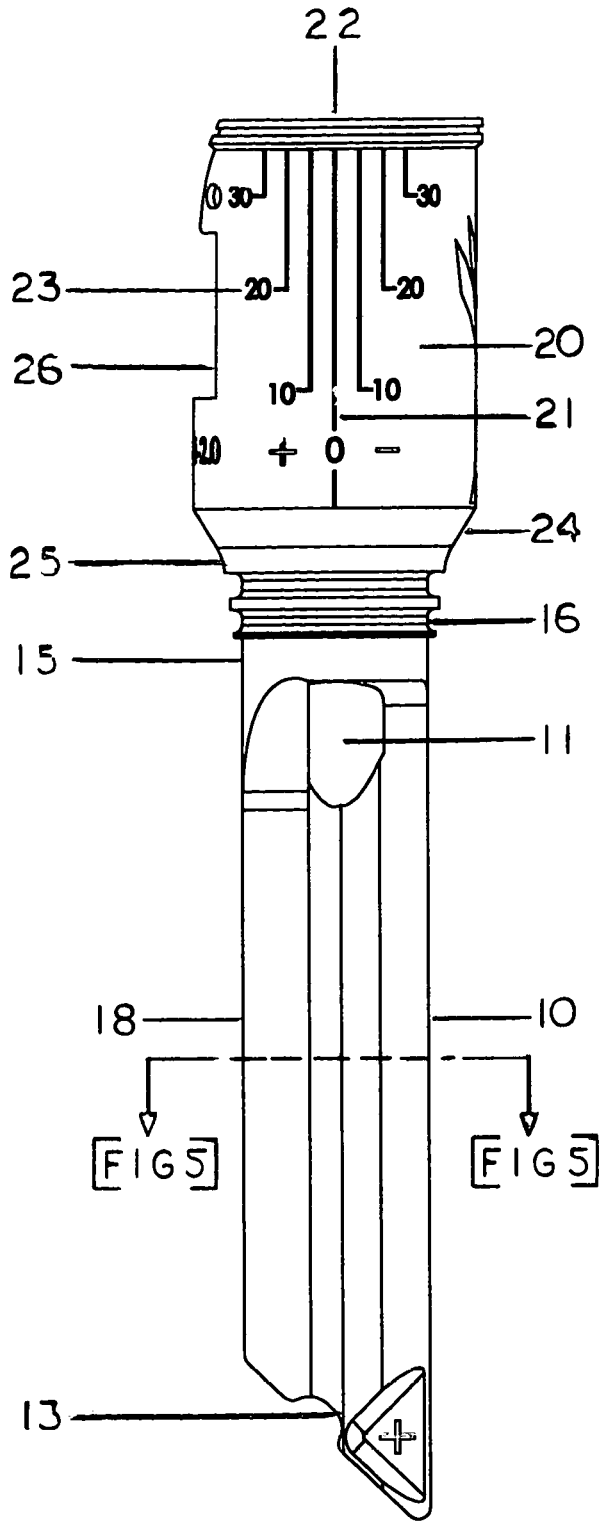
FIG. 3 is a side view of the retro fit or integral air and fuel flow diversion blade unit including an upper collar with a post installation visible incremental indexing marks allowing for precise rotational angle identification and indexing or tuning.

The basic preferred structures for the Intra-port mass air OR mass air & fuel flow diversion and vapor-phasing devices includes elements that are selected or excluded and mixed and matched to form several useful versions of the fuel injection system disclosed herein which is not necessarily limited to and include:

1. A mounting collar (FIGS. 1 & 2 No. 13 & 14),
2. seal landings (FIG. 2-4 No. 16),
3. a security retention flange (FIG. 2 No. 17),
4. an extended blade like structure (FIG. 5 No. 17)
5. an internal air and fuel mixing junction (FIG. 1-3 No. 11),
6. an internal hollow tubular venturi effect generating barrel (FIGS. 1 & 5 No. 12), AND,
7. a distribution nozzle (FIG. 1-3 No. 13).

Figure 5:
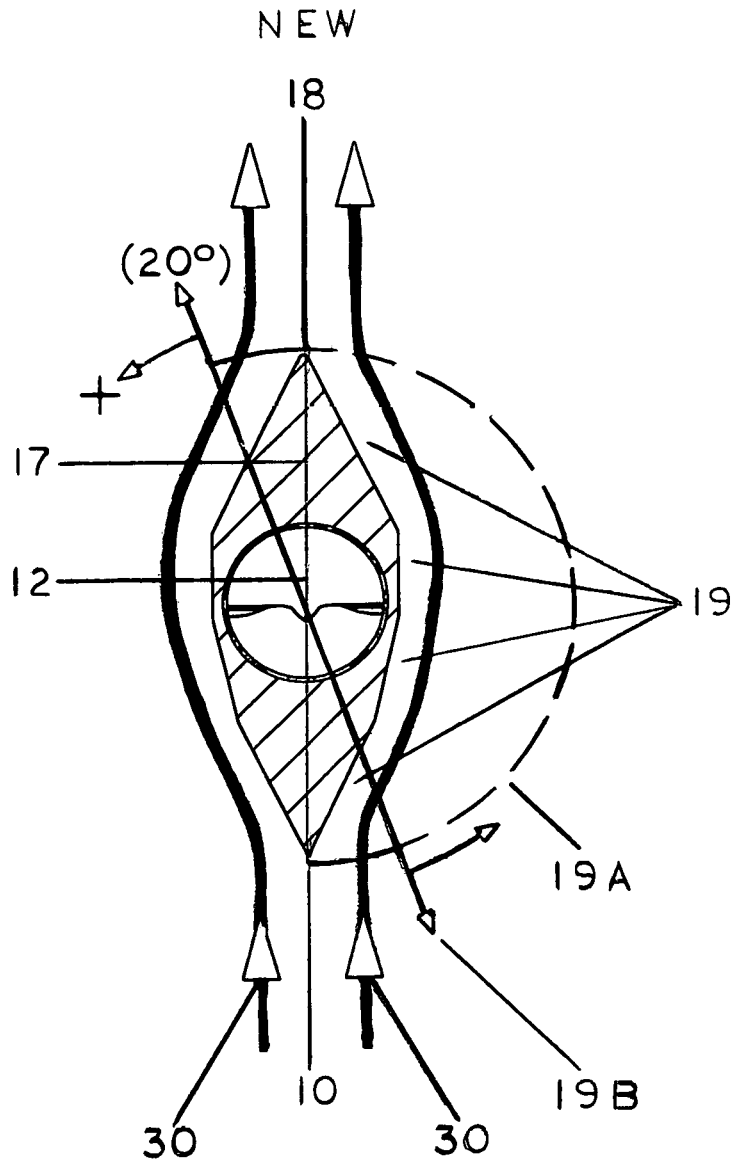
FIG. 5 as section referenced from FIG. 3 is a cross sectional cutaway top view of the intra-port air flow diversion blade profile with a hollow internal barrel structure as viewed looking down the barrel towards its distribution nozzle tip end.

The preferred "extended blade like structure" defined as a piece of solid material having a leading and a trailing edge (FIGS. 1-3 & 5 No. 10 & 18) connected on at least one (1) side by flat, straight, angled and/or curved surfaces the total linear combined length of which is less then a hemisphere sharing the same base diameter (FIG. 5 No. 19 & 19A). The purpose of the defined blade like structure is for determinate functional placement in-stream of the mass airflow within the induction conduit of a cycling IC engine. This purpose necessitates the blade to extend into the induction conduit which is why it is fully defined as an "extended blade like structure".

The "mixing junction" is defined as the area, point, gap and/or structure located proximately in between the inlet end of the "hollow tubular" structure and fuel spray nozzle tip end of the port fuel injector wherein fractionally diverted mass airflow first converges with the injected fuel mixing the two (2) elements together and accelerating them both into and through the hollow tubular structure.

As disclosed herein functionally aligned engagement with a port fuel injector can be accomplished either by integrating an intra-port flow diverting blade type unit as integral to the final construction of a typical port fuel injector, OR, through the application of a separate flow diverting blade unit as the type depicted in FIGS. 1-4 specifically designed for retro-fit of an existing port fuel injector.

Figure 1A:
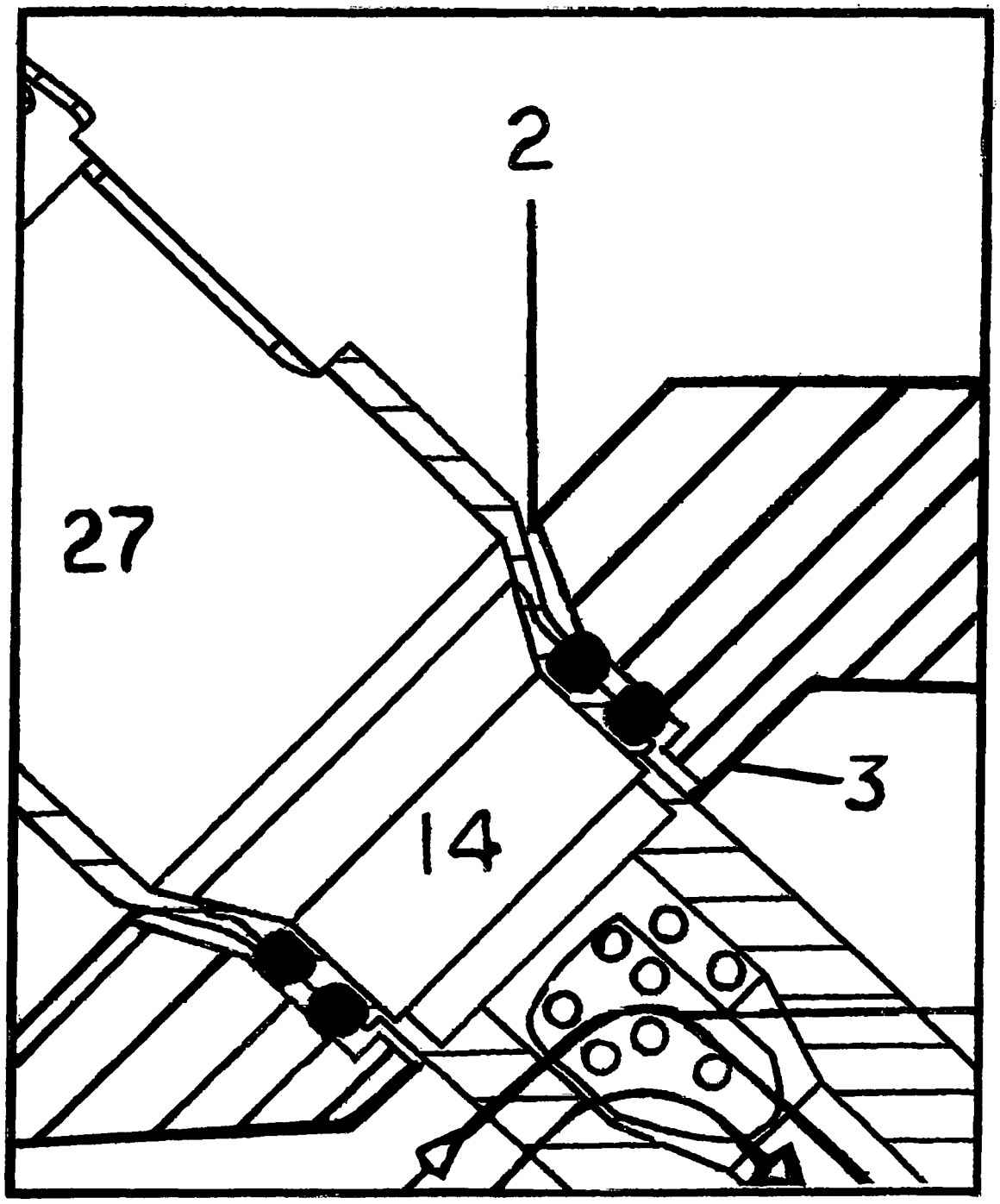
FIG. 1A is a magnified section of the cut away side view of FIG. 1 focusing on the stepped fuel injector mounting port of a typical port fuel injected IC engine and the collar seal arrangement and mixing junction of the air and fuel flow diversion blade unit.

Retro-fit can also be achieved by arranging an integral per-determined proximate coaxial functional engagement of a basic or similar structure with the fuel injector nozzle tip end by attaching it to the intra-port side of the fuel injector mounting sub-port (FIGS. 1 & 1A, No. 3), or, casting it in that same place as part of the OEM construction of the intake manifold or cylinder head of a typical IC engine. FIGS. 1 & 1A illustrates this fact by simply actualizing fusion of the parts by various means at points No. 2 &/or 3. Other retro-fit able intra-port installation methods could include attachment to an intake manifold gasket or the intake valve stem and/or guide boss. These other attachment methods may illuminate the need for a mounting collar, seal landings and/or a security retention flange. However, such methods would involve significantly more complex, time consuming and costly installation. Further, all of these alternative intra-port retentions means would most likely have to be fixed eliminating the very desirable post installation indexing and tuning capability associated with the preferred embodiments. These less preferred embodiments are nonetheless potentially useful and valuable improvements over the current IC engine design status.

In preferred embodiment No. 1, a retro-fit version of an intra-port air and fuel flow diversion device includes a small protruding lip or flange incorporated at the top end of the collar (FIG. 2 No. 7 4-7) to act as extra or redundant security to prevent, at anytime, including installation or dis-assembly, the device from becoming fully disengaged or detached from the fuel injector and/or fuel injector mounting sub-port where such an event could result in the costly, damaging and/or time consuming free intrusion of the device into the induction conduit.

As depicted in FIG. 1, the blade type unit extends into the main interior portion of the induction conduit (FIG. 1 No 1) of an IC engine designed to effectively directionally displace and/or divert a usefully significant but fractional portion of the rapidly flowing mass air stream, as depicted by the large arrows (FIG. 1 & FIG. 5 No. 30), by splitting it externally around a sharp leading edge (FIGS. 1 & 5 No 10) forcing it to displace rapidly along the outer blade profile (FIG. 5 No. 19) necessarily increasing its speed. This flow diversion activity reduces the proximate functional pressure at the distribution nozzle end of the blade (FIGS. 1-3 No 13). The low pressure at the distal distribution nozzle end in communication with the full conduit pressure intake and mixing junction end (FIGS. 1-3 No. 11) by way of the hollow barrel structure (FIGS. 1 & 5 No. 12). This pressure differential induces a small fractional portion of the mass air to deviate into the mixing junction (depicted by the small arrows ?, FIG. 1→→→) mixing with atomized liquid fuel from fuel spray nozzle tip end of a fuel injector at FIG. 1 No 11. Fuel and air are then engaged in rapid transit and transported at an accelerated rate and direction, independent of the mass air flow, down a gradient progressively partially constricted barrel (FIGS. 1 & 5 No 12) effective in generating and enhancing a venturi effect therein. This process mixes the atomized liquid fuel with inertia compressed air that experiences an instantaneous pressure change upon exiting the final distribution nozzle (FIGS. 1-3 No 13) sufficient enough to effect a phase change of the atomized liquid fuel to a vapor as depicted by the xxx in FIG. 1.

As depicted in FIGS. 1, 3 & 5, the amplitude, angle and direction of the mass air flow and vapor mixture can be precisely increased or decreased by simply incrementally changing the rotational angle of the blade unit altering its angle of attack relative to the linear direction of the mass air flow as represented by the large arrows located within the illustrated induction conduit in FIG. 1 and as wrapping around the outer blade profile in FIG. 5 No. 30. FIG. 5 further illustrates how the blade unit is rotated around its proximate longitudinal center axis from a neutral angle to one of many possible precisely selected angles, In this case 20°+ (FIG. 5 No. 19B Indexed to FIG. 3 No. 23).

Figure 4:
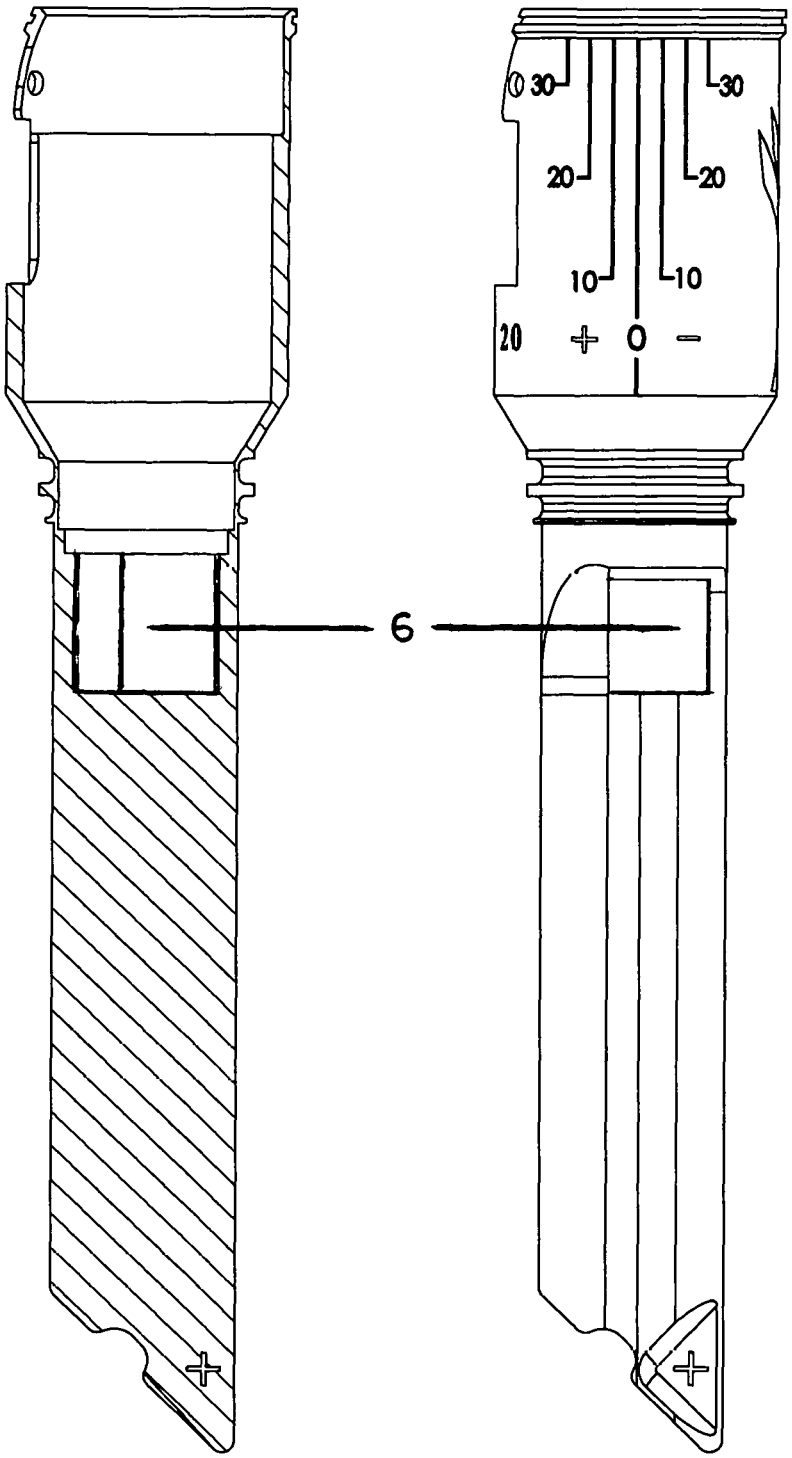
FIG. 4 is a cross sectional side and cutaway side view and a side view of the intra-port air flow diversion blade unit without a hollow internal barrel structure including an upper collar with a post installation visible section including incremental indexing marks allowing for precise rotational angle identification.

To further aid in the final manipulation of the angle of the blade, relative to the fuel injector and/or the longitudinal direction of the induction conduit and relative to a predetermined neutral angle, visible angle markings upon the outer surface of the blade unit's collar can be applied as depicted in FIG. 3 No. 20, 21 & 23 and/or can be added to the fuel injectors outer main body surface. This can be accomplished by machined groves, laser or other form of etching including screen printing. If something other than a neutral angle is desired it may be necessary to identify which cylinder receives a predetermined angle to the right or the left of the neutral or center angle indicated as a No. "+" or "–" of the "O" marked center line (FIGS. 3 & 4). In the case of certain V-Twin applications, for example, it would be helpful to identify which angle best applies to the front or rear cylinder.

In preferred embodiment No. 2, the retro-fit version of a flow diverting blade unit in preferred embodiment No. 1 does not include a gradient progressively partially constricted interior barrel structure and instead employs a solid blade structure as depicted in FIG. 4. The main goal is to allow for fixed or adjustable mass air flow diversion without significant fuel flow diversion or liquid fuel phase change at the same time. As depicted in FIG. 4, this embodiment does present an opportunity to divert injected liquid fuel in a myriad of ways as a natural consequence of its design primarily through the design of the depth and shape of the relief area below the collar (FIG. 4 No. 6). The floor of this relief area providing the main, but, not exclusive, fuel flow diversion control surface.

It may also be possible to extend the relief area below the collar (FIG. 4 No. 6) all the way to the distal end of the blade. Under normal circumstances this arrangement would not eliminate direct fuel flow diversion entirely but would emphasize the effect of the diverted airflow around the blade(s) on the speed, direction and condition of the injected fuel as it gets caught up in those altered forces therein.

In preferred embodiment No. 3, whether integral or retro-fit, the vapor phasing function is not arranged in functional engagement with any blade like structure as defined herein. Many other shapes such a simple through hollow tube like structure (FIG. 1 No. 12) with a substantially corresponding OD are capable of generating a pressure differential between the two (2) ends but not as effectively or efficiently as the blade like structure.

In preferred embodiment No. 4, a retro-fit version of a blade unit includes a means by which the fuel injector's lower or nozzle end 0-ring seal arrangement is can be by-passed to allow an expanded open end collar section (FIG. 3 No. 22) to extend above the fuel injector mounting sub-port (FIGS. 1 & 1A No. 2) on the intake manifold and therefore be visible after final installation as depicted in FIGS. 1, 1A, 3 & 4. Angle markings can be applied to this visible section alone or in addition to angle markings applied to the main outer body of the fuel injector itself to provide a means to readily and accurately identify and index the rotational angle of the mufti-function fuel injection system after installation into a typical IC engine as depicted in FIGS. 1 & 1A. This method also providing a means of effective heat shielding for the main body of the fuel injector (located in between the nozzle tip end and the pressurized fuel inlet end) allowing peak operating temperatures to be reduced enough to virtually eliminate heat related maintenance and/or failure as well as provide for improved appearance with visible marketing information such as a logo for one example.

In preferred embodiment No. 5, whether integral or retro-fit, the said blade unit may be machined or forged or cast or formed of various preferred materials not limited to and including, aluminum, titanium, magnesium, steel, stainless steel, copper, bronze, brass, carbon fiber or plastic.

The blade section itself may be machined or forged or cast or formed in various preferred cross sectional shapes not limited to and including hexagonal (as depicted in FIGS. 2-4) or air foil and either straight (as depicted in FIGS. 2-4) or curved, twisted or angled along its length. The blade section ID and/or OD could include a smooth, rough or dimpled surface(s) or cross sectional means for flow diversion.

Said embodiments 1 and/or 3 and/or 4 including a means to divert fuel through all or a portion of the length of the blade section by means of a hollow internal barrel structure in various configurations machined therein as depicted in FIGS. 1-3 4 & 5. Said internal barrel structure may be configured with a constricted section with a steep angled entry to form a funneling affect thereunto just below the main fuel injector nozzle as depicted in FIG. 1 No. 12. This configuration promotes a venturi effect to aid in the breakup and/or vaporization of the fuel before final distribution into the induction conduit. The internal barrel structure may be accompanied with a relief area just below the collar that allows the barrel to inject air and fuel and enhance fuel atomization and/or vaporization as depicted in FIG. 1. Said relief area could extend on one side or both through the length of the blade or any portion thereof. Further, said barrel arrangement can be connected to one (1) or more smaller distribution a sub ports at various cross angles.

Some said embodiments may include a notched relief at various points along the leading or trailing edge of the blade section in order to accommodate any intra-port obstructions such as the Chrysler HEMI engine requires (FIG. 2 No. 9).

Some said embodiments may include a blade section with an angled distal tip end as depicted in FIGS. 1-4 No. 13. The blade could also include a reduced and/or blunt edge running along all or a portion of its length thereof.

Any and/or all embodiments may include a main fuel injector nozzle designed to inject fuel in a pattern designed to enhance the overall performance of the fully assembled system.

What is claimed is:

1. An intra-port air and fuel flow diversion device for disposition within an internal combustion engine where said engine is capable of producing an intake cycle for inducing a mass airflow stream into a combustion chamber by way of a main port forming an induction conduit said induction conduit equipped with a fuel injector mounting sub-port defining a direct and open passage way from its outer surface to the intra-port section thereof for securely mounting a port fuel injector therein equipped with a fuel spray nozzle tip end, main body and pressurized fuel inlet end, arranged to allow for predetermined variably timed and metered injection of fuel into the induction conduit and mass airflow stream in at least one (1) pre-determined directional fuel flow path, comprising:

a. an intra-port mass airflow directional diversion means, in the form of a blade like shape and structure, defining, at least one (1) of a leading edge and trailing edge connected on at least one (1) side by flat, straight, angled and/or curved surfaces the total combined linear length of which is less than a hemisphere having the same base diameter, extending into the induction conduit and providing for diversion of a portion of the mass airflow stream therein from its natural flow path to a re-directional path around an outer surface of the blade like shape and structure when oriented in functionally aligned engagement with the fuel injector mounting sub-port and port fuel injector;

b. a secure mounting means providing for the secure placement of the intra-port mass airflow diversion means in functionally aligned engagement with the fuel injector mounting sub-port and port fuel injector;

c. a fuel flow diversion surface defined as at least one (1) directional control surface integral to final construction and/or assembly of the intra-port mass air flow diversion means and oriented within at least one (1) directional fuel flow path from the fuel spray nozzle tip end of the port fuel injector.

2. The intra-port air and fuel flow diversion device in claim 1, wherein the blade like shape and structure includes an intra-port through hollow tubular structure including a mixing junction at one end and a final distribution nozzle at another end, the mixing junction arranged in functionally aligned engagement with the fuel spray nozzle tip end of the port fuel injector in order to divert at least a portion of the injected fuel therein, and, in order to simultaneously divert a fractional portion of the mass airflow stream at full induction conduit pressure therein, with, the final distribution nozzle arranged to utilize energy from displacement of the mass airflow stream around its opening reducing its proximate functional pressure below that of the full conduit pressure forming an effective pressure differential between the mixing junction end and the distribution nozzle end forcing rapid transit of the said portion of diverted air and fuel along a set path within the hollow tubular structure toward and through the distribution nozzle at a speed and direction independent of the speed and direction of the mass airflow stream.

3. The intra-port air and fuel flow diversion device in claim 1, wherein the blade like shape and structure is adjustable with respect to an angle in relation to the induction conduit including a means to change a direction of a diverted air flow and/or increase or decrease an amplitude of the diverted air flow upon altering the angle of the intra-port air and fuel flow diversion device around its proximate longitudinal center axis.

4. The intra-port air and fuel flow diversion device in claim 2, wherein the blade like shape and structure is adjustable with respect to an angle in relation to the induction conduit including a means to change a direction of a diverted air flow and increase or decrease an amplitude of the diverted air flow upon altering the angle of the intra-port air and fuel flow diversion device around its proximate longitudinal center axis.

5. The intra-port air and fuel flow diversion device in claim 3, including a functionally visible indexing means in order to indicate a pre-determined precise incremental rotational angle of the intra-port air and fuel flow diversion device around its proximate longitudinal center axis relative to a pre-determined neutral angle.

6. The intra-port air and fuel flow diversion device in claim 4, including a functionally visible indexing means in order to indicate a pre-determined precise incremental rotational angle of the intra-port air and fuel flow diversion device around its proximate longitudinal center axis relative to a pre-determined neutral angle.

7. The intra-port air and fuel flow diversion device in claim 1, including: a security retention means to effectively provide extra or redundant retention security independent of and/or in addition to the secure mounting means, to prevent, at any time, including installation or disassembly, the intra-port air and fuel flow diversion device from becoming fully disengaged or detached from the port fuel injector and/or fuel injector mounting sub-port where such an event could result in unintended free intrusion of the intra-port air and fuel flow diversion device into the induction conduit.

8. The intra-port air and fuel flow diversion device in claim 2, including: a security retention means to effectively provide extra or redundant retention security independent of and/or in addition to the secure mounting means, to prevent, at any time, including installation or disassembly, the intra-port air and fuel flow diversion device from becoming fully disengaged or detached from the port fuel injector and/or fuel injector mounting sub-port where such an event could result in unintended free intrusion of the intra-port air and fuel flow diversion device into the induction conduit.

9. The intra-port air and fuel flow diversion device in claim 3, including: a security retention means to effectively provide extra or redundant retention security independent of and/or in addition to the secure mounting means, to prevent, at any time, including installation or disassembly, the intra-port air and fuel flow diversion device from becoming fully disengaged or detached from the port fuel injector and/or fuel injector mounting sub-port where such an event could result in unintended free intrusion of the intra-port air and fuel flow diversion device into the induction conduit.

10. The intra-port air and fuel flow diversion device in claim 4, including: a security retention means to effectively provide extra or redundant retention security independent of and/or in addition to the secure mounting means, to prevent, at any time, including installation or disassembly, the intra-port air and fuel flow diversion device from becoming fully disengaged or detached from the port fuel injector and/or fuel injector mounting sub-port where such an event could result in unintended free intrusion of the intra-port air and fuel flow diversion device into the induction conduit.

11. An intra-port air and fuel flow diversion device for disposition within an internal combustion engine where said internal combustion engine is capable of producing an intake cycle for inducing a mass airflow stream into a combustion chamber by way of a main port forming an induction conduit equipped with a fuel injector mounting sub-port defining a direct and open passage way from an outer surface to an intra-port section thereof for securely mounting a port fuel injector therein equipped with a fuel spray nozzle tip end arranged to allow for a pre-determined variably timed and metered injection of fuel into the induction conduit and mass airflow stream in at least one (1) pre-determined directional fuel flow path, comprising:

a. an intra-port through hollow tubular structure including a mixing junction at one end and a final distribution nozzle at another end, the mixing junction further comprising an air inlet extending from the induction conduit to the mixing junction and connected to the final distribution nozzle, arranged in functionally aligned engagement with the fuel spray nozzle tip end of the port fuel injector in order to divert at least a portion of the injected fuel therein, and, in order to simultaneously divert a fractional portion of the mass airflow stream at full induction conduit pressure therein, with, the final distribution nozzle arranged to utilize energy from displacement of the mass airflow stream around its opening reducing its proximate functional pressure below that of the full induction conduit pressure forming an effective pressure differential between the mixing junction end and the final distribution nozzle end forcing rapid transit of the said portion of diverted air and fuel along a set path within the intra-port through hollow tubular structure toward and through the final distribution nozzle at a speed and direction independent of a speed and direction of the mass airflow stream;

b. a secure mounting means providing for the secure placement of the intra-port through hollow tubular structure in functionally aligned engagement with the fuel injector mounting sub-port and port fuel injector.

12. The intra-port air and fuel flow diversion device in claim 11, including an intra-port mass airflow directional diversion means, in the form of a blade like shape and structure, defining, at least one (1) leading edge and trailing edge connected on at least one (1) side by flat, straight, angled and/or curved surfaces the total combined linear length of which is less than a hemisphere sharing the same base diameter, extending into the induction conduit and providing for diversion of a portion of the mass airflow stream therein from its natural flow path to a re-directional path around the blade's the blade like shape and structure's outer surface when oriented in functionally aligned engagement with the fuel injector mounting sub-port and port fuel injector.

13. The intra-port air and fuel flow diversion device in claim 12, wherein the blade like shape and structure is adjustable with respect to its angle in relation to the induction conduit including a means to change a direction of the diverted air flow and increase or decrease an amplitude of the diverted air flow upon altering an angle of the intra-port air and fuel flow diversion device around its proximate longitudinal center axis.

14. The intra-port air and fuel flow diversion device in claim 11, including a functionally visible indexing means in order to indicate a pre-determined precise incremental rotational angle of the intra-port air and fuel flow diversion device around its proximate longitudinal center axis relative to a pre-determined neutral angle.

15. The intra-port air and fuel flow diversion device in claim 12, including a functionally visible indexing means in order to indicate a pre-determined precise incremental rotational angle of the intra-port air and fuel flow diversion device around its proximate longitudinal center axis relative to a pre-determined neutral angle.

16. The intra-port air and fuel flow diversion device in claim 11, including a security retention means to effectively provide extra or redundant retention security independent of and/or in addition to the secure mounting means, to prevent, at any time, including installation or disassembly, the intra-port air and fuel flow diversion device from becoming fully disengaged or detached from the port fuel injector and/or fuel injector mounting sub-port where such an event could result in unintended free intrusion of the intra-port air and fuel flow diversion device into the induction conduit.

17. The intra-port air and fuel flow diversion device in claim 12, including a security retention means to effectively provide extra or redundant retention security independent of and/or in addition to the secure mounting means, to prevent, at any time, including installation or disassembly the intra-port air and fuel flow diversion device from becoming fully disengaged or detached from the port fuel injector and/or fuel injector mounting sub-port where such an event could result in unintended free intrusion of the intra-port air and fuel flow diversion device into the induction conduit.

18. The intra-port air and fuel flow diversion device in claim 13, including a security retention means to effectively provide extra or redundant retention security independent of and/or in addition to the secure mounting means, to prevent, at any time, including installation or disassembly, the intra-port air and fuel flow diversion device from becoming fully disengaged or detached from the port fuel injector and/or fuel injector mounting sub-port where such an event could result in unintended free intrusion of the intra-port air and fuel flow diversion device into the induction conduit.

19. A method for simultaneous control of a mass airflow stream within an induction conduit of a cycling internal combustion engine, en route to a combustion chamber, and of an injection of liquid fuel from a fuel spray nozzle tip end of a port fuel injector, and, a vapor phasing of said liquid fuel therein, comprising: acquiring by various means and for the use intended an intra-port air and fuel flow diversion device complete with a mixing junction at one end and a final distribution nozzle at another end connected by a hollow tubular structure, the mixing junction further comprising an air inlet extending from the induction conduit to the mixing junction and connected to the final distribution nozzle, and the intra-port air and fuel flow diversion device sized to easily fit within an interior section of the induction conduit; securely placing the intra-port air and fuel flow diversion device within the mass airflow stream with the mixing junction end in functionally aligned engagement with the fuel spray nozzle tip end of the port fuel injector; directing a pre-determined portion of the liquid fuel injected from the fuel spray nozzle tip end of the port fuel injector into the mixing junction end of a hollow tubular structure, and, simultaneously directing a pre-determined portion of the mass airflow stream within the induction conduit, en route to the combustion chamber, into the same said hollow tubular structure allowing both air and fuel to be transported rapidly within and through the hollow tubular structure at a speed and direction independent of a speed and direction of the mass airflow stream until forcibly exiting the final distribution nozzle thereof.

20. The method of claim 19, further comprising: directionally diverting a fractional portion of the mass airflow stream around an outer surface of the intra-port air and fuel flow diversion device using a blade like shape and structure affixed around, and, as part of the outer surface of the intra-port air and fuel flow diversion device.

21. The method of claim 19, wherein the intra-port air and fuel flow diversion device is securely attached and married to the port fuel injector, a rotational angle of the intra-port air and fuel flow diversion device being variably fixable along the port fuel injector's proximate longitudinal center axis.

22. The method of claim 20, wherein the intra-port air and fuel flow diversion device including the blade like shape and structure affixed around the outer surface being securely attached and married to the port fuel injector, a rotational angle of the intra-port air and fuel flow diversion device being variably fixable along the port fuel injector's proximate longitudinal center axis.

* * * * *